US005746277A

United States Patent [19]

Howell, Jr.

[11] Patent Number: 5,746,277

[45] Date of Patent: May 5, 1998

[54] DRILLING APPARATUS

[76] Inventor: Richard L. Howell, Jr., 6711 Park Ave., Garden Grove, Calif. 92645

[21] Appl. No.: 554,301

[22] Filed: Nov. 6, 1995

[51] Int. Cl.[6] ..... F21C 5/12

[52] U.S. Cl. ..... 173/184; 173/27; 173/39; 173/44; 173/147; 173/193

[58] Field of Search ..... 173/43, 44, 81, 173/89, 141, 147, 149, 151, 27, 42, 184, 193, 194, 195

[56] References Cited

U.S. PATENT DOCUMENTS

| | | | |
|---|---|---|---|
| 1,971,922 | 8/1934 | Smith | 173/44 |
| 3,216,511 | 11/1965 | Ladd et al. | 173/19 |
| 3,426,857 | 2/1969 | Bland | 173/151 |
| 3,520,374 | 7/1970 | Ebert | 173/147 |
| 3,753,468 | 8/1973 | Casagrande | 173/147 X |
| 4,035,969 | 7/1977 | Casagrande | 173/147 X |
| 4,137,974 | 2/1979 | Decker | 173/151 X |
| 4,199,033 | 4/1980 | Van Gundy, Jr. | 173/27 |
| 4,627,499 | 12/1986 | Magee et al. | 173/193 |
| 4,645,084 | 2/1987 | Deike | 173/194 |
| 4,877,091 | 10/1989 | Howell, Jr. | 173/89 |
| 5,630,477 | 5/1997 | Minatre | 173/147 |

*Primary Examiner*—Scott A. Smith

*Attorney, Agent, or Firm*—F. Eugene Logan

[57] ABSTRACT

Augering device is disclosed which is useful for drilling holes in the ground at various angles under relatively low overhead or ceiling conditions. The device is suitable for mounting on a wide variety of vehicles ranging from the bed of small pickup trucks to very large track type caterpillars with booms. The device has an extendable mast powered by a downcrowding mechanism, a kelly assembly, and a kelly rotating mechanism. The extendable mast has a first mast member and a second mast member. A downcrowding hydraulic cylinder extends the second mast member away from the first mast member and pulls the second mast member towards the first mast member. The telescoping kelly sections include at least an outer kelly section and an inner kelly section. The outer kelly section has an axis parallel to but spaced apart from the axis of the first mast member. A bearing rotatable supports the outer kelly section and prevents axial displacement of the outer kelly section relative thereto. Structure supports the kelly bearing and causes displacement of the outer kelly section along its axis in response to axial displacement of the second mast member relative to the first mast member. The kelly rotating mechanism slidably rotates the outer kelly section. Structure supports the first mast member and the kelly rotating mechanism.

29 Claims, 12 Drawing Sheets

DRILLING APPARATUS

BACKGROUND OF THE INVENTION

Non-rotating kelly sections are shown in a drilling device in U.S. Pat. No. 1,971,922. The weight of the device, which does not have a power downcrowding mechanism, forces the auger into the around.

U.S. Pat. No. 3,216,511 shows a crawler track vehicle with a drop hammer on the end of the boom.

U.S. Pat. No. 3,426,857 shows a drilling device with a single kelly supported from the end of a boom of a track type vehicle. The single kelly bar slides through a housing of a rotatable guide which rotates the kelly. The rotatable guide is supported frame attached to the lower portion of the boom. No means of downcrowding is provided. Another rig with telescoping kelly sections is shown in U.S. Pat. No. 3,753,468. The outer kelly section slides axially within a guidance sleeve supported at its top end by the free end of the boom and at its bottom end by a hydraulic cylinder attached to the track type vehicle. Telescopic sections and control are also described in U.S. Pat. No. 4,035,969.

U.S. Pat. No. 4,137,974 shows telescoping kelly sections driven by a rotary table. The housing of the rotary table is mounted at the lower end of relatively tall derrick. The kelly sections when retracted are surrounded by the derrick structure. Downcrowding is achieved by a mechanism which includes a drum having two cables wound in opposite senses thereon. The drum is hydraulically driven. A pulley system is mounted on the top of the derrick and another pulley system is mounted on the top of the outer kelly section. The pulley systems and the derrick would make it difficult to interchange the kellys since free access to the top of the kelly sections is not possible in such a rig.

An augering device mounted on a backhoe is shown in U.S. Pat. No. 4,199,033. The downward force exerted by the boom of the backhoe drives the auger into the ground. A trunnion device mounted between the end of the boom and the augering device allows a variety of angles of the auger relative to the backhoe.

U.S. Pat. No. 4,627,499 shows a drilling device supported on the end of a boom of a track type vehicle. The drilling device is of the drill mast type with a single kelly bar which slides through a housing of a final drive unit. The axis of the mast and kelly bar appear to be the same. Because the mast is directly over the kelly bar a relatively high overhead or ceiling is required for drilling vertical holes.

U.S. Pat. No. 4,645,084 discloses a device for drilling holes mounted in the side panels of a truck bed. A hydraulic jack is used to downcrowd the casing relative to the elbow.

A more useful downcrowdable augering apparatus having kelly sections is disclosed in U.S. Pat. No. 4,877,091. The apparatus of U.S. Pat. No. 4,877,091 is very useful in sites having low overhead or ceiling. In U.S. Pat. No. 4,877,091 the kelly rotating means is bolted directly to the outer kelly section and as a consequence the outer kelly section is not permitted to slide through the kelly rotating means. Since the top of the kelly assembly is closed changing and/or replacing the kelly sections is more difficult than if the top of the outer kelly section were open.

SUMMARY OF THE INVENTION

The present invention is an improvement in augering apparatus and is concerned with making such apparatus and rigs readily adaptable to mounting on a wide variety of vehicles ranging from light truck beds a to large track type vehicles including caterpillar type machines. Non-limiting examples of vehicles in which the augering means of this invention can be used are shown in U.S. Pat. No. 4,199,033 for a backhoe, and U.S. Pat. No. 3,216,511, U.S. Pat. No. 4,627,499 and U.S. Pat. No. 4,877,091 for crawler vehicles with rotatable booms. Because of its improved construction this invention is cheaper to manufacture and maintain. The invention facilitates maintenance and changing of kelly assemblies by its unobstructed access to the top of the kelly assembly. For example the top of the kelly assembly is free of rotary drive mechanisms and pulleys associated therewith.

Accordingly, there is provided by the principles of this invention augering means comprising extendable mast means having a first mast member and a second mast member, downcrowding means for extending the second mast member away from the first mast member and for pulling the second mast member towards the first mast member, kelly assembly means having a plurality of telescoping kelly sections which includes at least an outer kelly section and an inner kelly section, and kelly bearing means for rotatably supporting the outer kelly section The outer kelly section has an axis which is parallel to and spaced apart from the axis of the first mast member. The kelly bearing means is also for preventing axial displacement of the outer kelly section relative to the kelly bearing means.

The augering means also comprises first support means for supporting the kelly bearing means, and for causing displacement of the outer kelly section along its axis in response to displacement of the second mast member along the axis of, and relative to, the first mast member. The augering means includes kelly rotating means for slidably rotating the outer kelly section about the axis thereof, and second support means for supporting the first mast member and the kelly rotating means.

In one embodiment, the extendable mast means is non-rotatable relative to the second support means.

In one embodiment, the downcrowding means includes a hydraulic cylinder connected to first mast member and the second mast member. In another embodiment, the downcrowding means is located within the first mast member and within the second mast member.

In one embodiment, the inner kelly section is driven directly by the outer kelly section. In another embodiment, the inner kelly section is driven indirectly by the outer kelly section, and the plurality of kelly sections is from 3 to 15. In still another embodiment, the plurality of kelly sections is from 7 to 11. In yet another embodiment, the plurality of kelly sections is 9.

In one embodiment, the kelly sections have stops only on two adjacent distal ends of each section thereby enabling more kelly sections to be included within a given outer kelly section which permits longer extension of the kelly assembly and deeper holes to be drilled. Conventional square tubular with stops on all four faces of the kelly sections are shown in U.S. Pat. No. 4,137,974 and U.S. Pat. No 4,877,091.

In one embodiment, the response to axial displacement is proportional. In another embodiment, the first support means causes displacement of the outer kelly section along the axis thereof equal to the axial displacement of the second mast member relative to the first mast member.

In one embodiment, the kelly rotating means is driven by chain drive means. In another embodiment, the kelly rotating means is driven by gear drive means. In still another embodiment, the kelly rotating means is hydraulically powered.

In one embodiment, the first support means is fixed to the second mast member.

In one embodiment, the second support means includes a rotary table. Non-limiting examples of rotary tables useful for this invention are shown in U.S. Pat. No. 3,426,857, U.S. Pat. No. 4,137,974 and U.S. Pat. No. 4,627,499 the last two of which are hereby incorporated herein by reference. U.S. Pat. No. 4,137,974 is an example of a gear driven rotary table.

In one embodiment, the augering means comprises means for restricting the second mast member to slidable movement along the axis of the first mast member.

In another embodiment, the second mast member is tubular and slidable over the first mast member with a clearance therebetween, and the clearance is operable for maintaining axial alignment of the second mast member with the axis of the first mast member. In still another embodiment, the first mast member is tubular and has an inner surface and an outer surface, the second mast member is tubular and has an inner surface and an outer surface, and the inner surface of the second mast member is slidable over the outer surface of the first mast member.

In one embodiment, the first mast member and the second mast member have approximately a polygonal tubular configuration in cross section. In another embodiment, the first mast member and the second mast member have approximately a square tubular configuration in cross section. Non-limiting examples of square tubular kelly sections are shown in U.S. Pat. No. 4,137,974 and U.S. Pat. No. 4,877,091. In still another embodiment, the first mast member and the second mast member have approximately a circular tubular configuration in cross section. In a further embodiment, one of the first mast member and the second mast member includes a male key section oriented parallel to the axis of the first mast member, and the other one of the first mast member and the second mast member includes a female key section slidable over the male key section.

In one embodiment, the augering means further comprising kelly retraction means for retracting the plurality of telescoping kelly sections and for permitting extension thereof. In one embodiment, the kelly retraction means comprises winch means supported by the second mast member, pulley means fixed to the second mast member, swivel means connected to the inner kelly, and a cable connected to the swivel means and the winch means and carried by the pulley means. In a still further embodiment, the winch means includes means for aligning the cable thereon. In one embodiment, the winch means is pivotally supported by the second mast member. In another embodiment, the kelly retraction means includes means for tensioning the cable between the winch means and the pulley means.

There is also provided by the principles of this invention an improved winch means for retracting kelly sections which comprises a drum rotatably supported by a winch frame member. The drum is for coilable storage of a cable attached at one of its ends to the drum and at the other of its ends to one of the kelly sections. The winch means includes motor means for rotating the drum, and mounting means. The mounting means is for attaching to a downcrowding means and has a pivot axis which lies in a plane perpendicular to, but offset from, the drum axis. The mounting means is for pivotally supporting the winch frame member about the pivot axis, thereby enabling the cable to be wound onto the drum at an approach angle approximately perpendicular to, but offset from, the drum axis regardless of where on the drum the cable is wound. In one embodiment, the augering means further comprising yoke means having an axis perpendicular to the axis of the first mast member. The yoke means is for rotating the outer kelly section about the axis of the yoke means. In another embodiment, the yoke means has a first member rotatably mounted on a second member about the yoke axis, and the second support means is fixed to the first member. Non-limiting examples of yoke means and left-right tilt means useful for this invention are shown in U.S. Pat. No. 4,199,033 and U.S. Pat. No. 4,877,091 which are hereby incorporated herein by reference.

DESCRIPTION OF THE PREFERRED EMBODIMENTS

Figure 1:
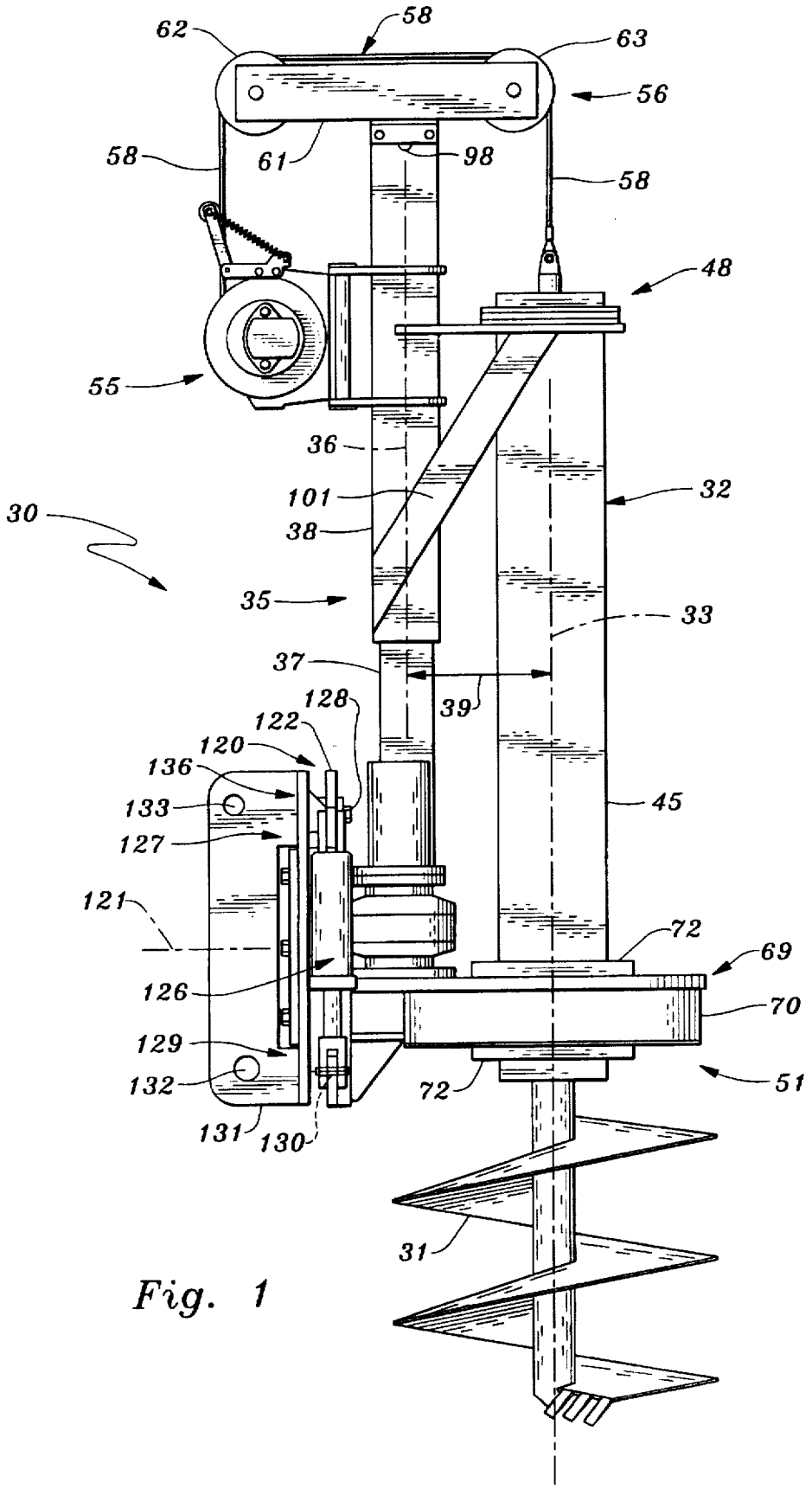
FIG. 1 is a left side elevational view of the augering means with the mast fully extended.
Figure 2:
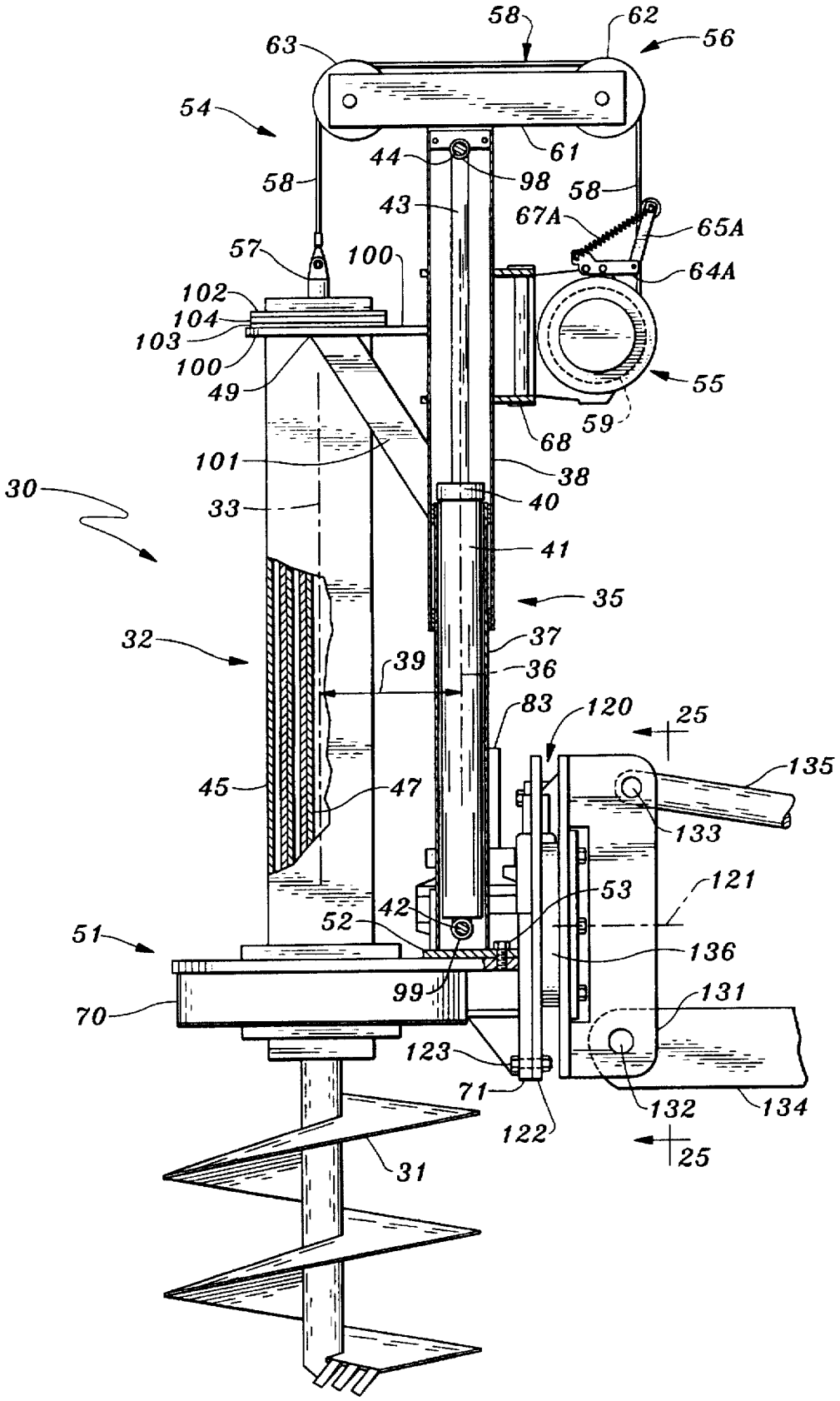
FIG. 2 is a right side elevational view of FIG. 1 with the mast shown in cross section.
Figure 3:
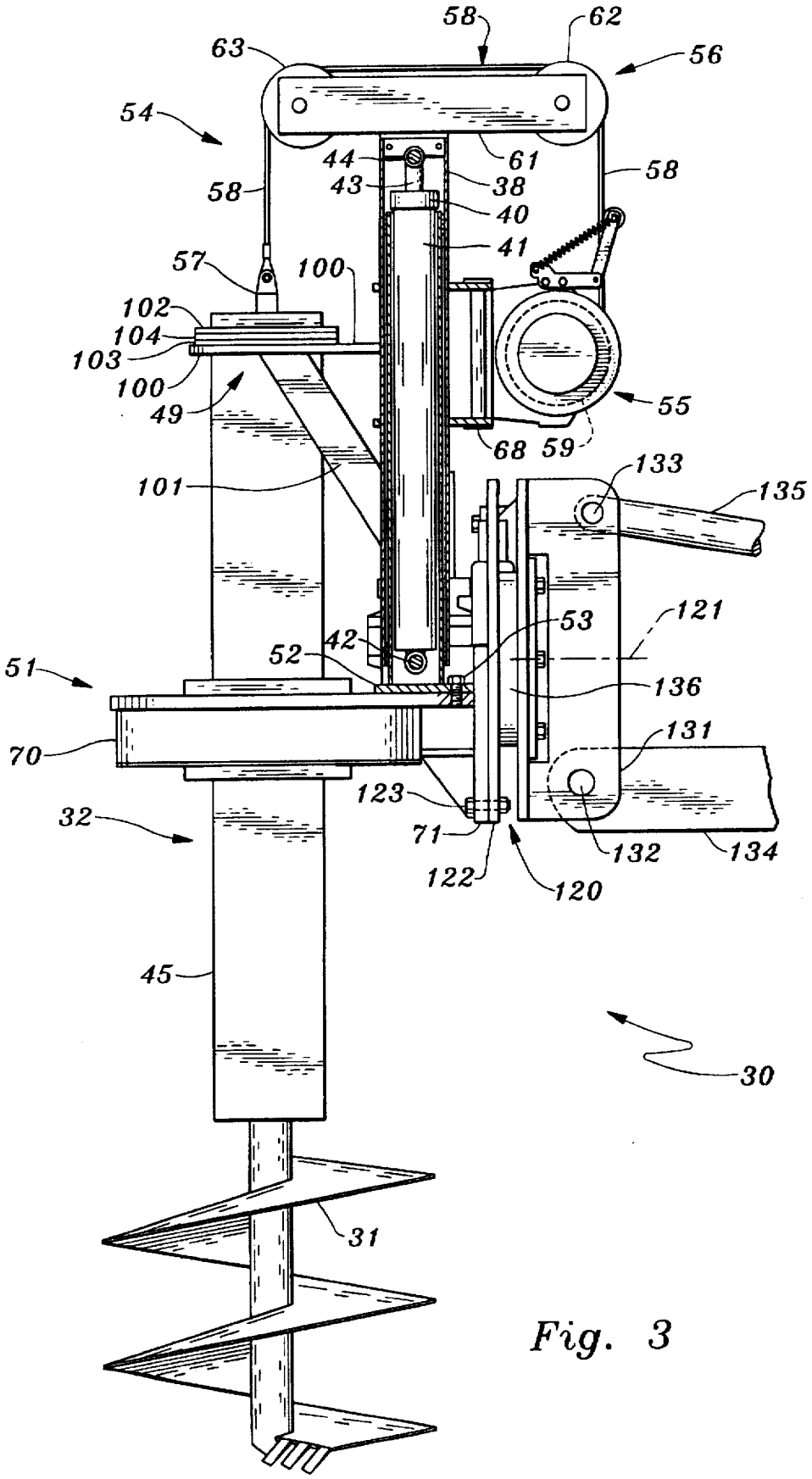
FIG. 3 is a right side elevational view of the augering means of FIG. 2 with the mast downcrowded.
Figure 8:
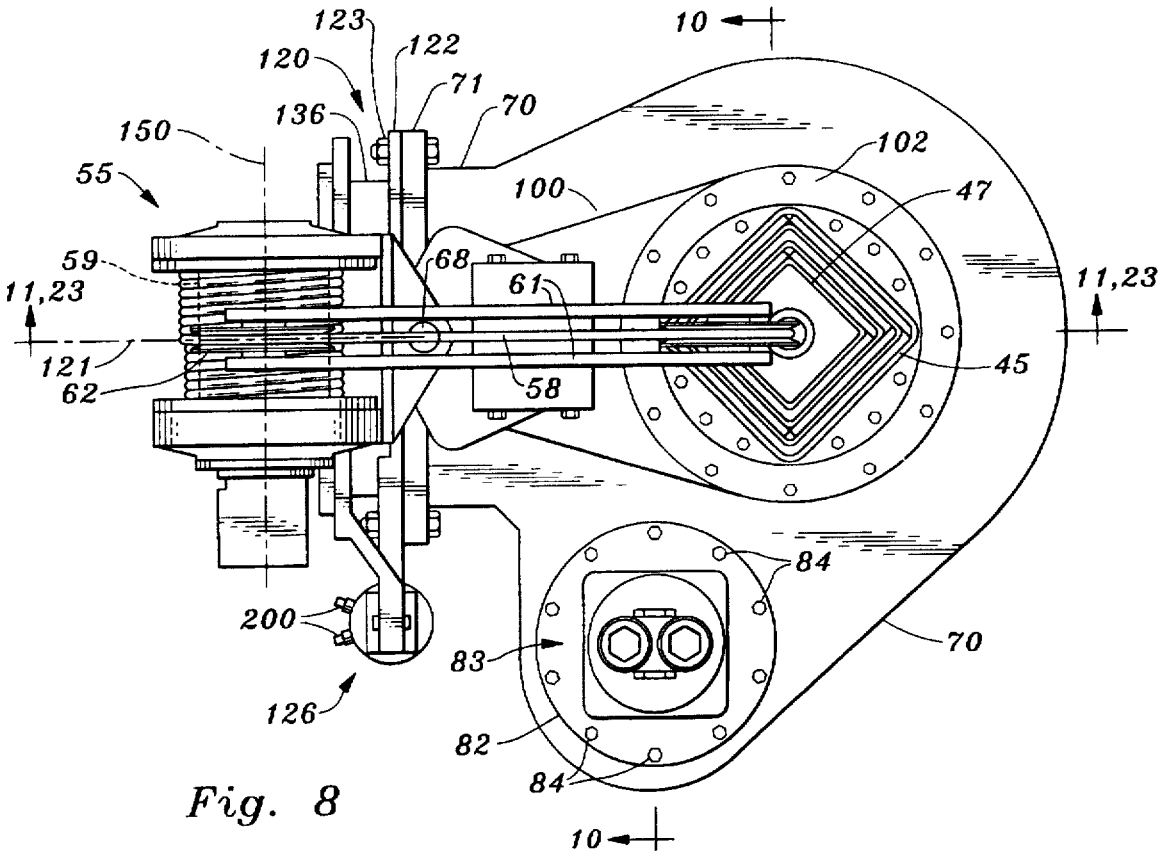
FIG. 8 is a top plan view of the augering means of FIG. 1.
Figure 9:
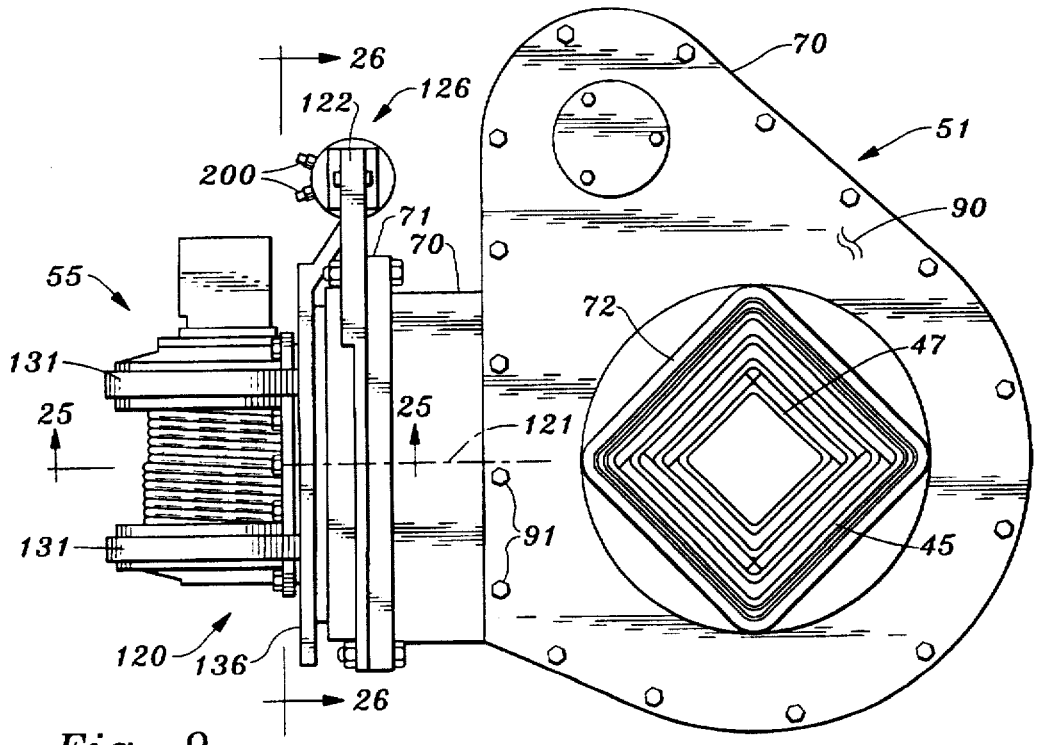
FIG. 9 is a bottom plan view of the augering means of FIG. 1 but shown without the augering tool.

FIGS. 1 and 2 show left and right side elevational views, respectively, of an augering means, generally designated by numeral 30, of this invention with an augering tool 31 attached. FIGS. 8 and 9 show the top and bottom plan views of the augering means of FIGS. 1 and 2. In order to better illustrate the augering means the augering tool 31 is not shown in FIG. 8.

Augering means 30 comprises a kelly means 32, and an extendable mast means 35 having a first mast member 37 having an axis 36 and a second mast member 38. As shown in FIG. 2 the first and second mast members are tubular with the second mast member 38 being slidable over the first mast member 37. In this embodiment, members 37 and 38 have a square tubular cross section, however tubular cross sections other than square can be used if desired. Inside the first and second mast members is a hydraulic cylinder 40 with its cylinder body 41 pivotally connected by pin 42, which is mounted in opposing holes 99, to the bottom portion of the first mast member 37. In a similar manner, cylinder rod 43 is pivotally connected to the top portion of the second mast member 38 by pin 44. The distal ends of pin 44 are mounted in opposing holes 98 in the top portion of second mast member 38. Hydraulic cylinder 40 therefore provides down-crowding means for extending the second mast member away from the first mast member and for pulling the second mast member towards the first mast member.

Kelly means 32 comprises a plurality of telescoping kelly sections or bars which include at least an outer kelly section or bar 45 and an inner kelly section or bar 47. Axis 36 of first mast member 37 is parallel to and displaced a distance 39 away from axis 33 of outer kelly section 45. Outer kelly section 45 is rotatably supported by kelly bearing means 48 which also prevents axial displacement of the outer kelly section relative to means 48. Kelly bearing means 48 is mounted in support means 49 which rigidly attached to second mast member 38. In the embodiment shown in FIGS. 21 and 22, kelly assembly means 32 also includes interjacent kelly sections or bars 46A, 468, 46C, 46D and 46E (referred to collectively as interjacent kelly sections 46) between kelly sections 45 and 47. More or less interjacent kelly sections, or none, can be used if desired.

The augering means also comprises kelly rotating means 51 for slidably rotating the outer kelly section 4S, and support means 69 for supporting kelly rotating means 51 and extendable mast means 35. Support means 69 includes frame or housing 70. First mast member 37 is rigidly attached to plate 52 by welding. Plate 52 is bolted to frame 70 with bolts 53.

As the extendable mast means 35 is extended, cylinder rod 43 elevates and displaces the second mast member 38 along axis 36 away from first mast member 37. Thus outer kelly section 45, which is rigidly attached to second mast member 38 by support means 49, is displaced upwardly along its axis 33 the same axial distance that second mast member 38 is displaced by hydraulic cylinder 40. The axial displacement of the outer kelly section 45 therefore is a function of the axial displacement of the second mast member 38 and in this embodiment the function is proportional and the proportion ratio is 1/1. However, support means having other functional relationships, including non-proportional functions, can be used if desired. Such other functional relationship can include levers and/or gears which can increase or decrease the relative axial displacement of outer kelly section 45 to the axial displacement of second mast member 38. Thus support means 49 provides means for supporting the kelly bearing means 32, and for causing displacement of the outer kelly section 45 along the axis thereof in response to axial displacement of the second mast member 38 relative to the first mast member 37.

Figure 21:
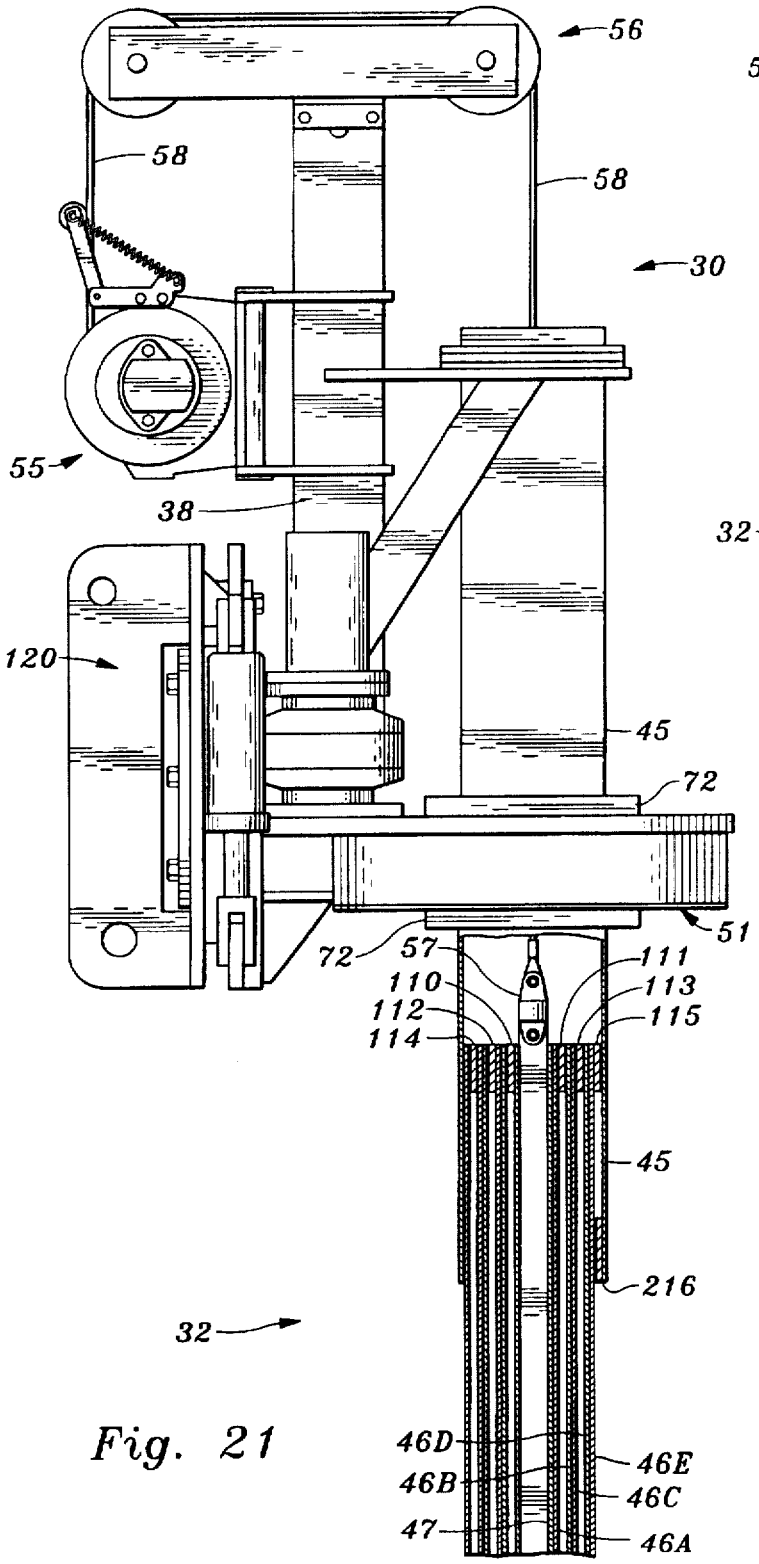
FIG. 21 is an enlarged elevational cross-sectional view of the kelly subassembly showing the upper stops.
Figure 24:
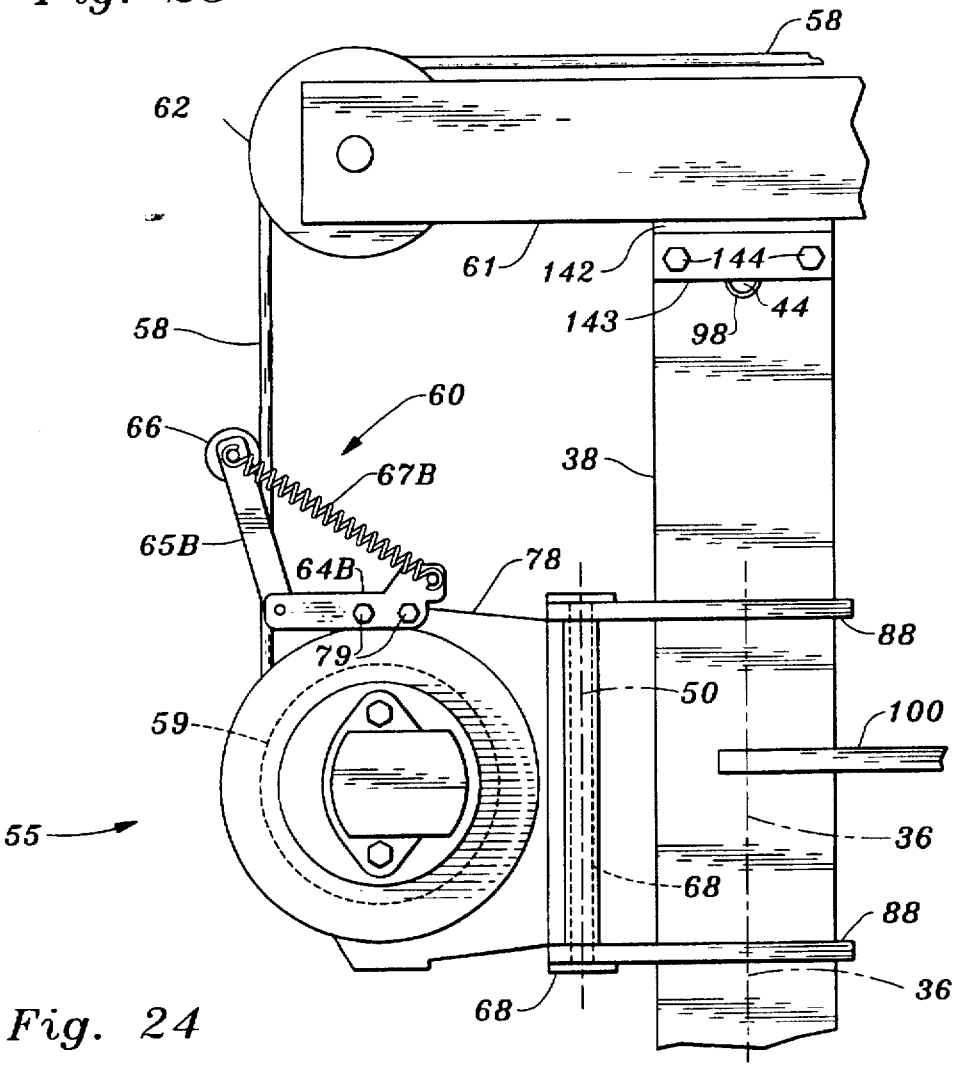
FIG. 24 is an enlarged view of the winch system.

Augering means 30 also comprises kelly retraction means 54 which includes winch means 55 supported by upper and lower braces 88 which are welded to second mast member 38, pulley means 56 fixed to the second mast member 38, swivel means 57 connected to the inner kelly 47, and a cable 58 connected to the swivel means 57 and the winch means 55 and carried by the pulley means 56 as shown in FIGS. 24, 8 and 21.

Pulley means 56 includes spanner members 61 which rotatably supports pulleys 62 and 63 as shown in FIGS. 1, 8 and 24. Spanner members 61 are welded to the top of plate 142. Opposing plate members 143 are welded to the bottom of plate 142, and members 143 are fastened to the top portion of second mast member 38 with bolts 144. Winch means 55 is pivotally mounted on second mast member 38. One end of cable 58 is attached to swivel means 57 and the other end thereof is attached to a drum 59 of winch means 55.

Kelly retraction means 54 also includes cable tensioning and alignment means 60 which comprises right side hinged members 64A and 64B, left side hinged members 65A and 65B, roller 66, and right and left springs 67A and 67B, respectively, as shown in FIGS. 2 and 24. Members 64A and 64B are mounted on opposite sides of body frame 78 of winch means 55 by bolts 79. Members 65 and 65B are pivotally mounted at one end to one end of members 64A and 64B, respectively. Roller 66 is rotatably supported between the distal or other end of members 65A and 658. Springs 67A and 67B, which are connected between the one end of members 64A and 64B, respectively, and the distal end of members 65 and 65B, respectively, force roller 66 against, cable 58. Since cable tensioning and alignment means 60 is attached to the frame of winch means 55, means 60 moves with winch means 55 which is pivotally attached to mast member 38 by pivoting means 68 which has an axis 50 parallel to axis 36.

The pivotability of winch means 55 about an axis 50 parallel to axis 36 of mast member 38 in combination with cable tensioning and alignment means 60 insures that cable 58 is wound on drum 59 in abutting adjacent spirals thereby preventing problems with the cable as it is deployed from, and rewound on, drum 59. Also the pivotability of winch means 55 enables the cable to be coiled on the drum at an approach angle approximately perpendicular to the drum axis 150 regardless of where on the drum the cable is wound. This is shown in FIG. 8 where cable 58 leaves pulley 62 and is deployed straight down into the plane of the figure at an approach angle that is approximately perpendicular to, but offset from, drum axis 150 regardless of where on the drum the cable is wound. This is especially important where the drilling apparatus is used in low overhead drilling sites such as inside, or egress through, an existing structure where the ceiling height is limited. The augering means used in such sites will have a relatively short distance between pulley 62 and winch means 55. Without the pivotal mounting of the winch means about axis 50, such short spacing between pulley and winch can cause cable problems.

Figure 10:
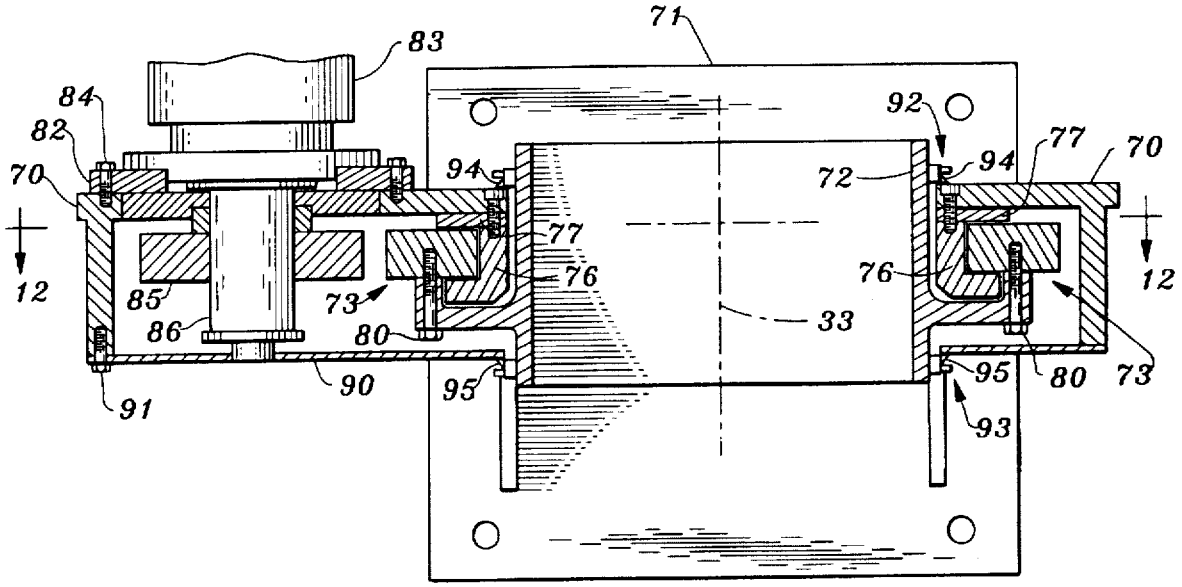
FIG. 10 is cross-sectional view taken through line 10—10 of FIG. 8 showing details of the rotary table as seen from the front.
Figure 11:
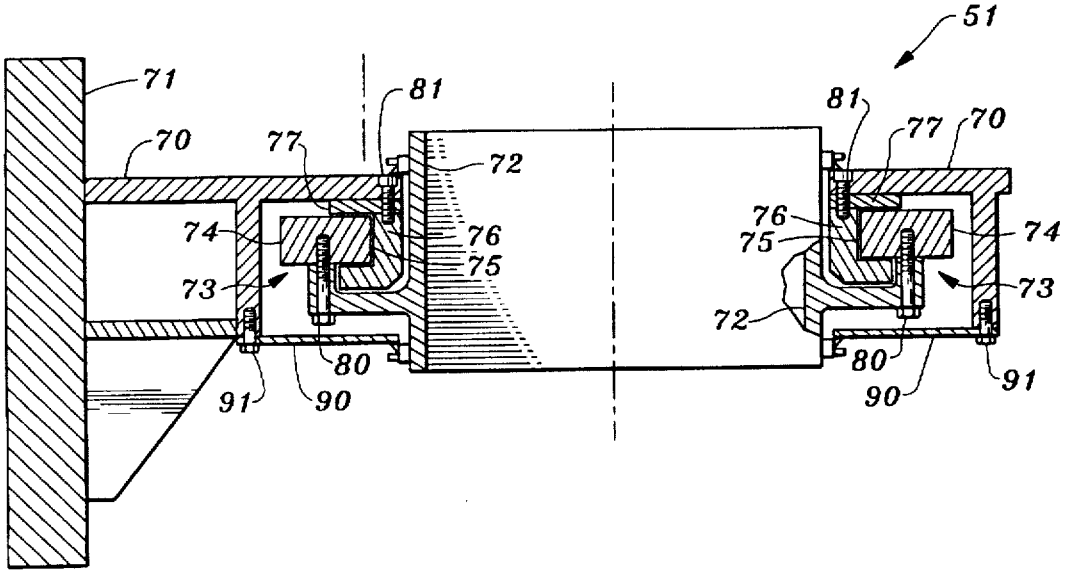
FIG. 11 is cross-sectional view taken through line 10—10 of FIG. 8 showing details of the rotary table as seen from the left side.
Figure 13:
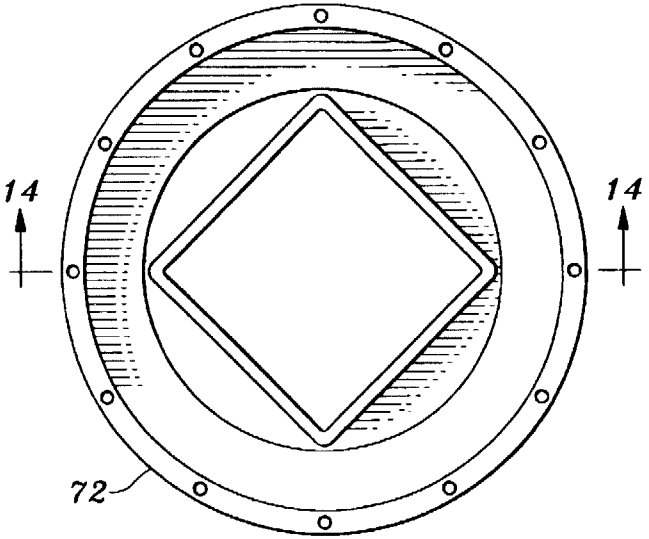
FIG. 13 is a top view of the kelly drive shroud.
Figure 14:
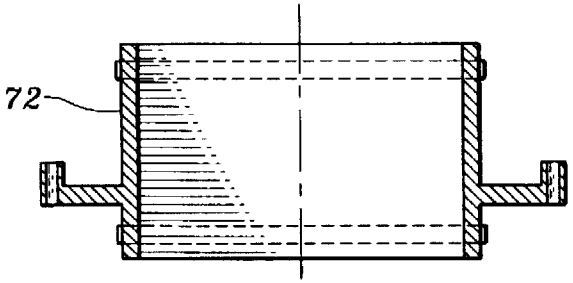
FIG. 14 is cross-sectional view taken through line 14—14 of FIG. 13.
Figure 12:
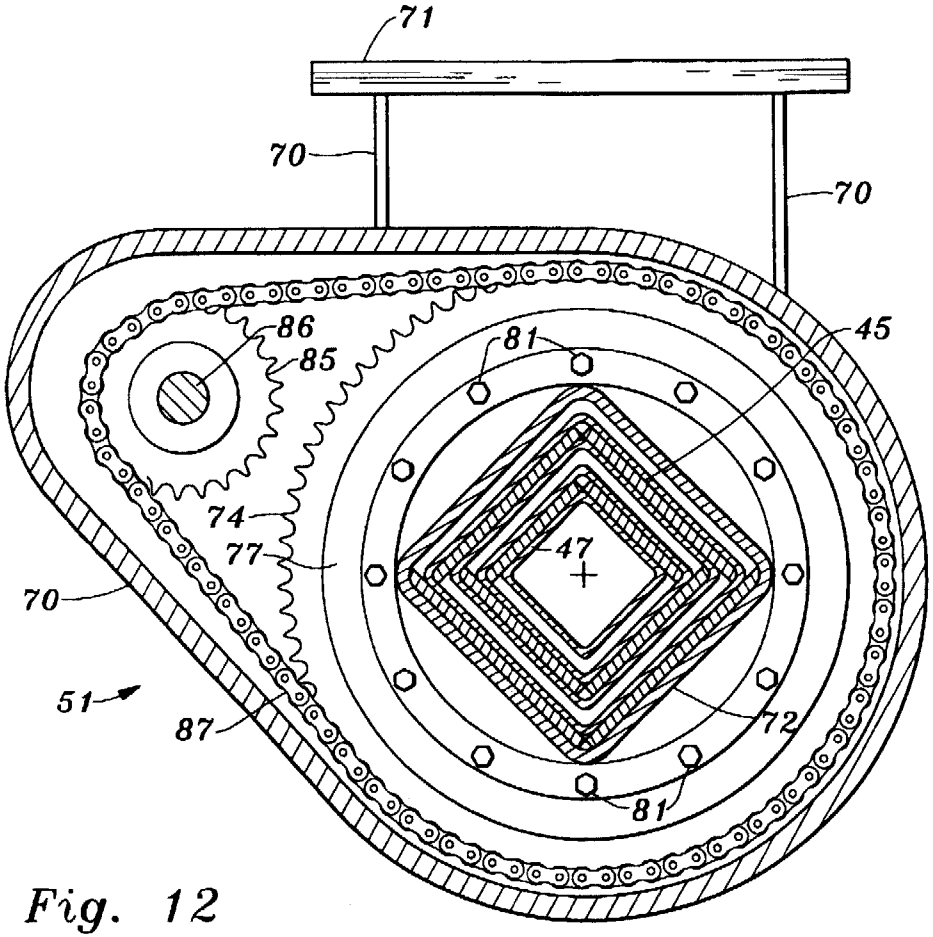
FIG. 12 is a detail view of the drive train of the rotary table taken through line 12—12 of FIG. 10.

Details of the means 51 for slidably supporting and rotating the outer kelly section 45 and for supporting extendable mast means 35 are shown in FIGS. 10–12. FIGS. 10 and 11 are cross-sectional views showing details of the rotary table and support structure as seen from the front and left side, respectively. FIG. 12 is a detail view of the drive train of the rotary table as seen from a cutaway through the top of the rotary table. Top and bottom plan views of means 51 are also shown in FIGS. 8 and 9.

In particular, means 51 comprises a support frame or housing 70 which is fixed to plate 71 by welding. The driven portion of the means 51 comprises kelly drive shroud 72, driven sprocket assembly 73, shroud bearing 76, and spacer ring 77. Driven sprocket assembly 73 comprises driven sprocket 74 and bronze bearing overlay 75. Shroud 72 is fixed to sprocket 74 with bolts 80. Bearing 76 and ring 77 are fixed to frame 70 with bolts 81.

The frame 82 of rotary motor 83 is bolted to frame 70 with bolts 84. A driving sprocket 85 is mounted on output power shaft 86 of rotary motor 83. Sprocket 85 drives continuous chain 87 which drives sprocket 74. Rotary motor 83 is preferably hydraulic powered but can be electrically powered if desired Although a chain drive is shown, a gear drive system can also be used if desired. U.S. Pat. No. 4,137,974 discloses details of one particular gear driven rotary table.

Cover plate 90 is bolted to frame 70 with bolts 91. Upper and lower seal assemblies 92 and 93, respectively, having flexible members 94 and 95, respectively, provide protection to the drive train from the environment, which is usually very dusty with soil or dirt particles.

Figure 19:
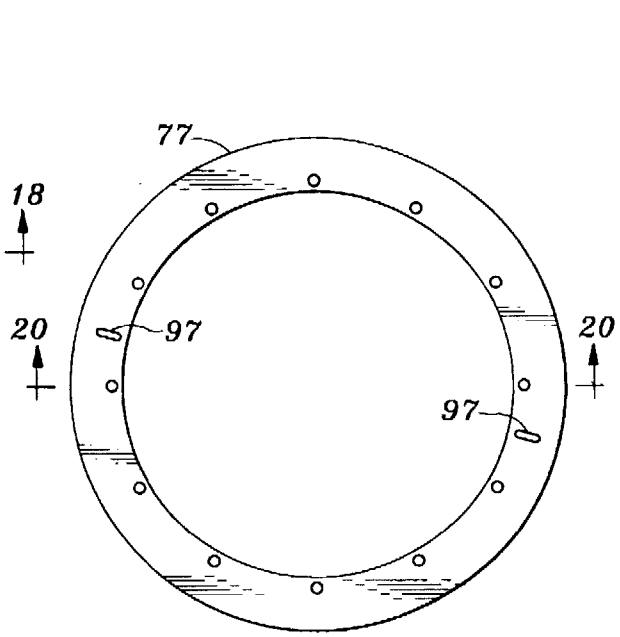
FIG. 19 is a top view of the spacer ring.
Figure 20:
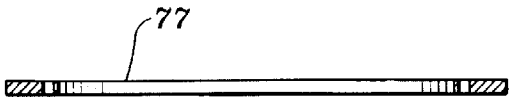
FIG. 20 is cross-sectional view taken through line 20—20 of FIG. 19.
Figure 17:
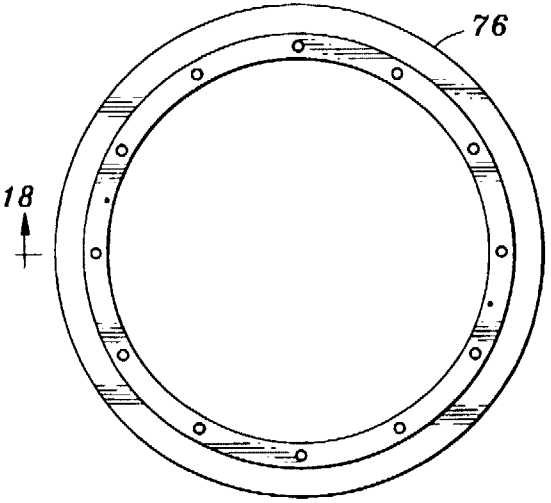
FIG. 17 is a top view of the bearing plate.
Figure 18:
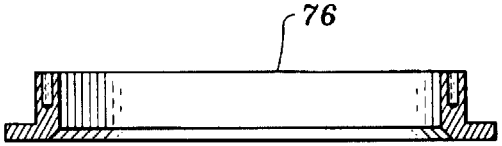
FIG. 18 is cross-sectional view taken through line 18—18 of FIG. 17.
Figure 15:
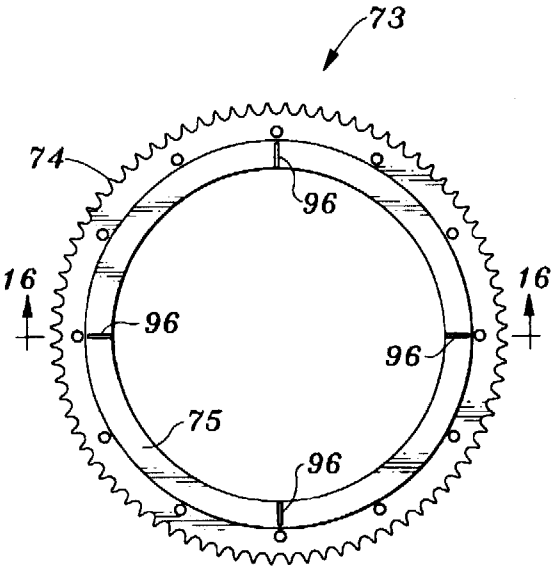
FIG. 15 is a top view of the kelly sprocket assembly.
Figure 16:
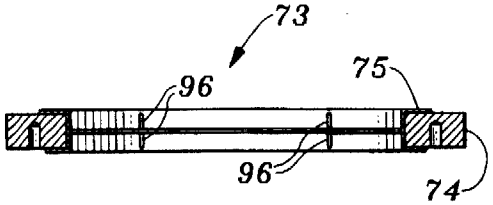
FIG. 16 is cross-sectional view taken through line 16—16 of FIG. 15.

Additional details of kelly drive shroud 72, driven sprocket assembly 73, shroud bearing 76, and spacer ring 77 are shown in FIGS. 13–20. Bronze overlay 75, shown in FIGS. 15–16, contains channels 96 which provide lubrication passageways for grease distribution. Channels 97 shown on spacer 77 in FIG. 19 are for distribution of grease or other lubricant.

In this arrangement it can be seen that outer kelly section 45 is permitted to slide axially within shroud 72 while shroud 72 is being rotated by the rotary drive system. However, all axial positions of outer kelly section 45 relative to means 51 require some portion of outer kelly section 45 to be surrounded by shroud 72, whether the extendable mast means is downcrowded to its lower limit, or extended to its upper limit as shown in FIGS. 1–7, or at heights intermediate of these limits. This is also true regardless of the number of kelly sections or the length to which the kelly sections are extended. Thus means 51 includes bearing means for slidably supporting the outer kelly section 45, and a rotary motor 83 and drive train for rotating outer kelly section 45.

Figure 23:
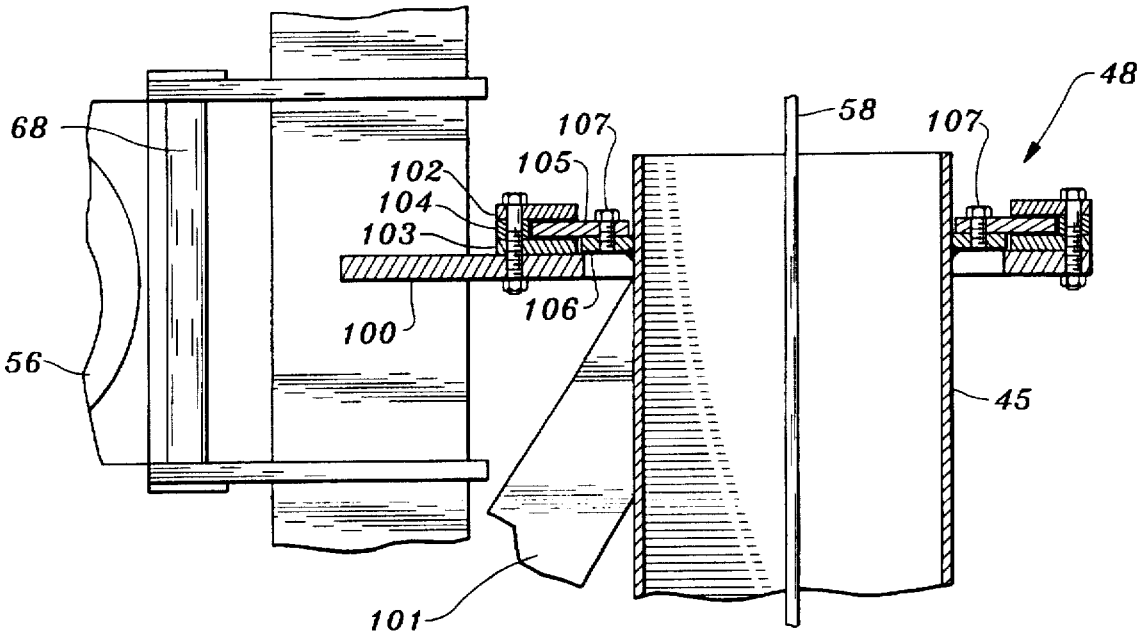
FIG. 23 is a cross-sectional view taken in the direction of line 23—23 of FIG. 8 showing the details of the upper kelly bearing.

As shown in FIG. 23, support means 49 comprises annular support member 100 and diagonal support members 101, upper ring 102, lower ring 103 and middle ring 104. Kelly bearing means 48 comprises bearing 105 which is mounted on flange 106 with bolts 107. Flange 106 is welded to outer kelly section 45.

Figure 22:
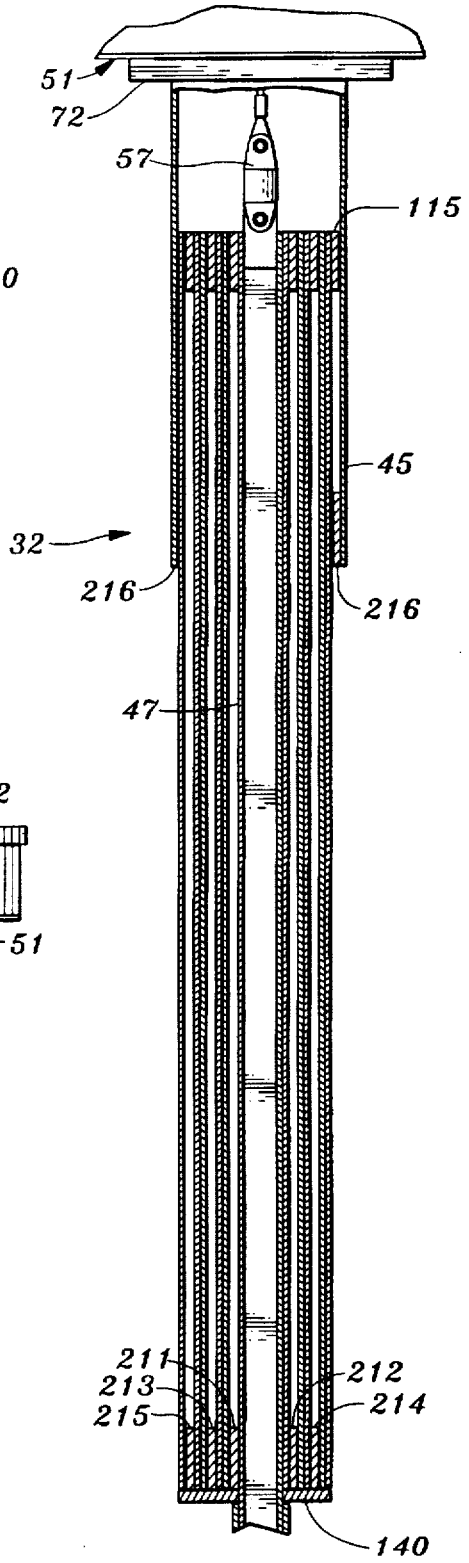
FIG. 22 is an elevational cross-sectional view of the kelly subassembly showing the upper and lower stops.

More kelly sections can be included in any given area by having upper stops only on two adjacent sides rather than all four sides of each kelly sections. This is illustrated in FIGS. 21 and 22. The four faces of the kelly sections will be referred to as the west, north, east and south faces. This is achieved by having upper stops 110 on the inner kelly 47 only on its west and north outer faces. The next adjacent kelly section 46A has upper stops 111 only on its east and south outer faces. While the next adjacent kelly section 468 has upper stops 112 only on its west and north outer faces. In the embodiment shown in FIGS. 21 and 22 other upper stops on interjacent kelly sections 46 are stops 113, 114 and 115. Thus the location of the upper stops on the outer faces is alternated between the west and north pair and the east and south pair of adjacent kelly sections.

Lower stops on the inner faces of outer kelly section 45 and interjacent kelly sections 46 are also provided but only on the inner opposite faces as the upper stops. Lower stops 211, 212, 213, 214 and 215 on outer faces of interjacent kelly sections 46A, 46B, 46C, 46D and 46E, and 216 on outer kelly section 45 are shown in FIGS. 21 and 22. In such arrangement the axis of inner kelly section 47 and outer kelly section 45 can be made to coincide if the total number of kelly sections is an odd number. If an even number of kelly sections is used then one way of minimizing any eccentricity between the axis of outer kelly section and inner kelly section, if desired, is to make the number of lower stops between the outer kelly section and upper stops on the kelly section adjacent thereto four, thereby insuring that the axis of the inner kelly section 47 and the entire kelly assembly coincides. However, since an even complement of kelly sections or bars would only cause a concentric error of about one eighth of an inch such corrective measures are usually of little or no concern.

Turning now to the hole drilling operation using this invention, FIGS. 1 and 2 show the augering means with extendable mast means 35 fully extended and all kelly completely retracted. This represents the starting position for beginning hole drilling FIGS. 3–7 illustrate how a typical drill operation proceeds using the augering means of this invention. The operation begins by placing the augering means thereby, in the fully extended mast configuration of FIGS. 1 and 2, over the location where the hole is to be drilled Drilling begins by downcrowding the extendable mast means fully to the position shown in FIG. 3. The extendable mast means 35 is then fully extended, i.e. elevated, thereby removing the augering tool 31 from the just drilled hole and the soil removed from the augering tool. This can be easily accomplished by spinning the tool over a location spaced away from the hole.

Figure 4:
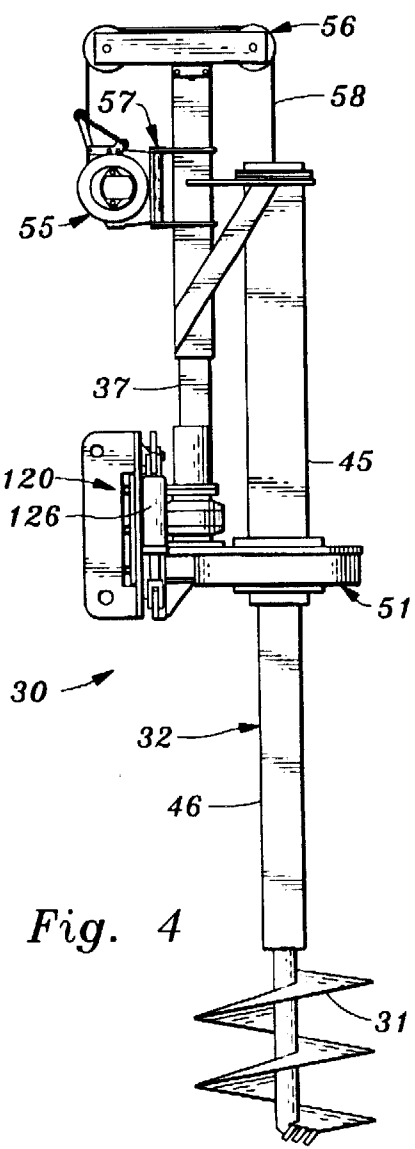
FIG. 4 is a left side elevational view of FIG. 3 with one kelly section extended.

The operation proceeds by returning augering tool 31 over the hole and allowing the cable to unwind from the winch means the kelly assembly to drop augering tool 31 down to the bottom of the hole as shown in FIG. 4. Approximately one kelly section is now extended. Drilling resumes by downcrowding the extendable mast means fully to the position shown in FIG. 5. The extendable mast means 35 is then fully extended and the kelly section retracted with the winch means thereby again removing the augering tool 31 from the deeper hole. The soil is removed from the augering tool in the same manner as before by spinning the tool over the location spaced away from the hole.

Figure 6:
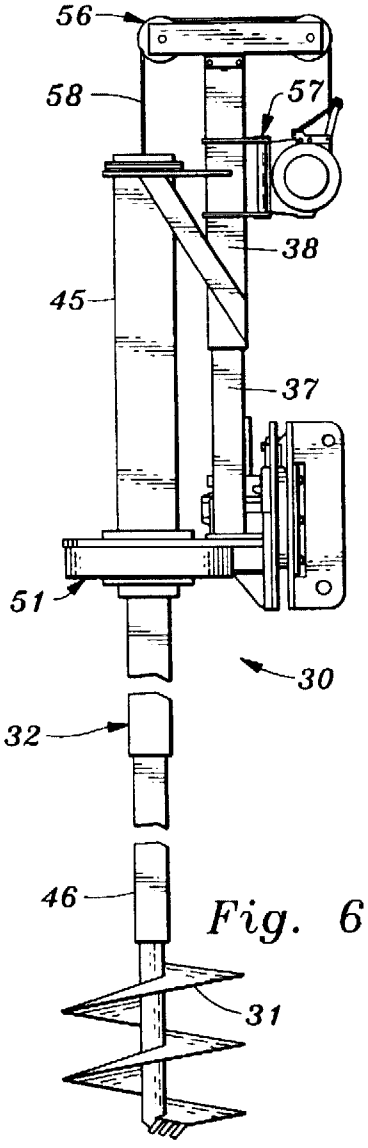
FIG. 6 is a right side elevational view of the augering means of FIG. 5 but with the mast extended and two sections of the kelly extended.
Figure 7:
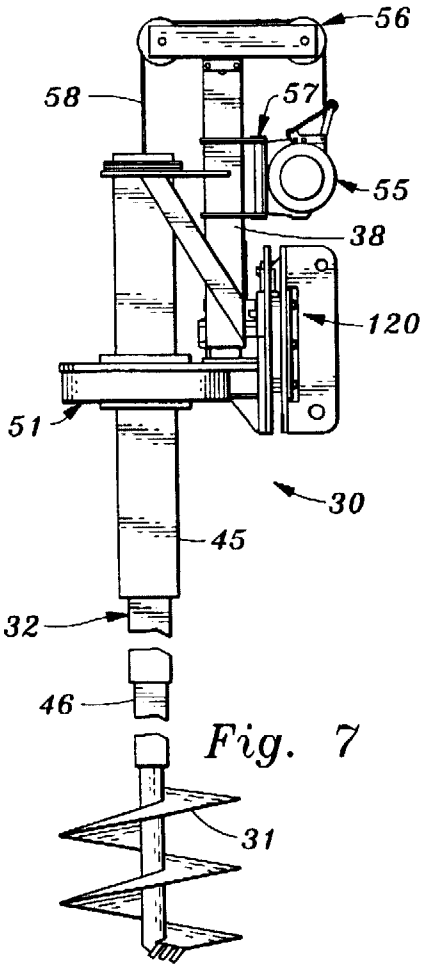
FIG. 7 is a right side elevational view of the augering means of FIG. 6 but with the mast fully downcrowded and two sections of the kelly extended.
Figure 5:
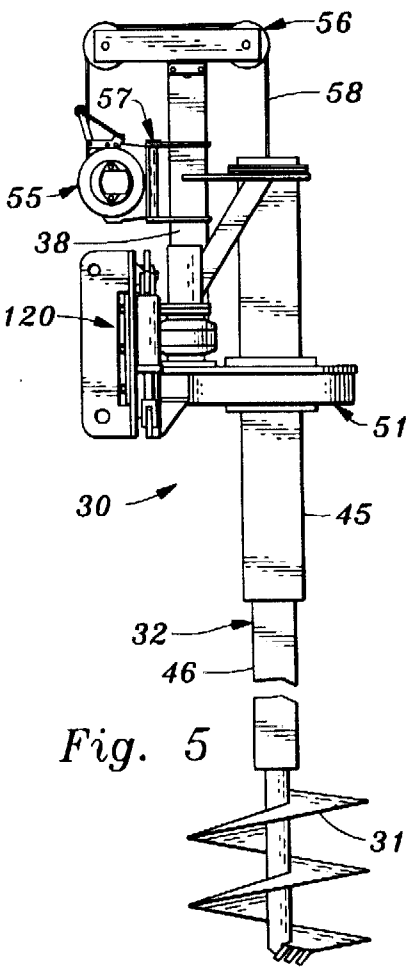
FIG. 5 is a left side elevational view of the augering means with the mast fully downcrowded and one section of the kelly extended.

The operation is continued by returning angering tool 31 over the hole and the cable to unwind from the winch means allowing the kelly assembly to drop augering tool 31 down to the bottom of the hole as shown in FIG. 6 where approximately two kelly sections are now extended. Drilling proceeds by downcrowding the extendable mast means fully to the position shown in FIG. 7. The extendable mast means 35 is then fully extended and the kelly sections retracted with the winch means thereby again removing augering tool 31 from the hole, and the soil removed from the augering tool over the location spaced away from the hole.

The augering tool is again placed over the hole and, using the winch means as before, the kelly assembly and augering tool allowed to drop down to the bottom of the hole. Drilling is resumed in the hole by downcrowding the extendable mast means as before. The augering tool is again removed from the hole and the soil removed. Then with the extendable mast means fully extended the hole is again entered by uncoiling the cable from the winch means and the drilling resumed. The operation is repeated until the desired hole depth is completed.

When reentering a drilled shaft the kelly sections are allowed to extend usually while the kelly bars are not being rotated or rotated slowly. When rotation and drilling is resumed friction between the kelly bars prevents their axial slippage so that no additional mechanism is required to prevent axial slippage of the extended bars.

Figure 25:
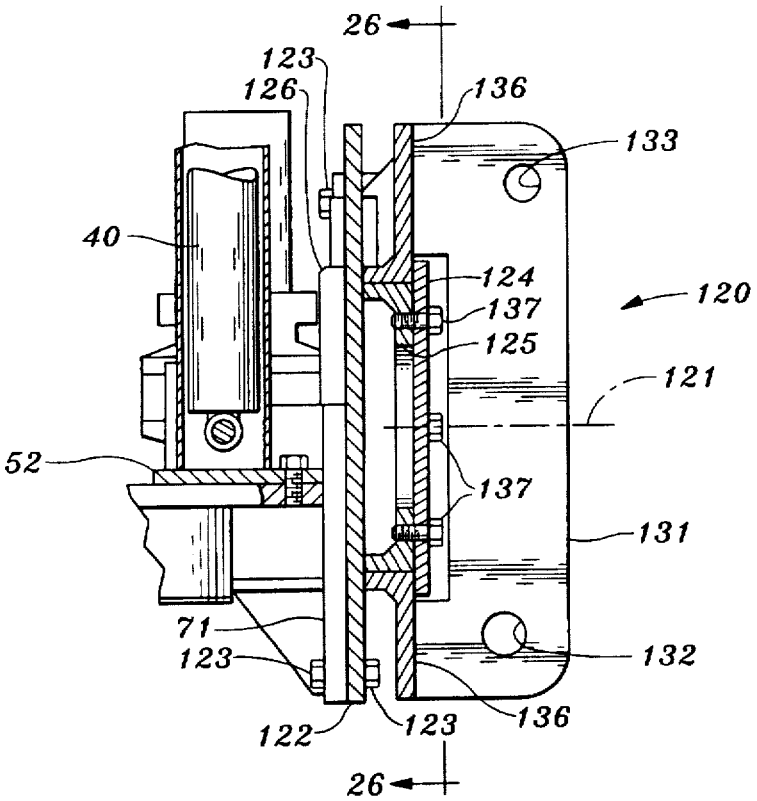
FIG. 25 is a cross-sectional view taken in the direction of line 25—25 of FIG. 2 showing the details of the left-to-right tilt means.

To facilitate positioning of augering tool 31 at any angle desired to the drill site, plate 71 is pivotally mounted to left-to-right tilt means 120. A detailed cross-sectional view of the left-to-right bearing means is illustrated in FIG. 25. Left-to-right tilt means 120 includes plate 122 which is connected to plate 71 by bolts and nuts 123. Left-to-right axle means 125 is welded to plate 122, and plate 124 is connected to left-to-right axle means 125 by bolts 137. Axle means 125 has axis 121 which is perpendicular to axis 33 of kelly means 32. Tilt means 120 includes left-to-right hydraulic cylinder 126. The distal cylinder end 127 of hydraulic cylinder 126 is pivotally connected to bearing plate 136 by pin 128. The distal rod end 129 of hydraulic cylinder 126 is connected to plate 122 by pin 130. Yoke plates 131 are welded to bearing plate 136 perpendicular thereto. Axes 33 and 36 lie in the plane that is approximately midway between yoke plates 131 when augering means 30 is not tilted relative to yoke plates 131. Thus activation of cylinder 126 causes axle means 125 and plate 122 to rotate to the left or to the right about axis 121 relative to bearing plate 136.

Yoke plates 131 contains spaced apart holes 132 and 133. Holes 132 are for pivotally mounting to the distal end 134 of a boom of an excavator (not shown in the drawings), and holes 133 are for pivotally mounting the distal rod end 135 of a boom hydraulic cylinder means of the excavator as shown in FIG. 2. By extending or retracting the cylinder rod connected to hole 133 to and from its hydraulic cylinder, the axis of kelly means 32 can be tilted to the from front to back as desired. An example of a left-to-right bearing means and front-to-back tilt means mounted on the distal end of a boom of excavator is shown in U.S. Pat. No. 4,877,091. Hydraulic connections to hydraulic cylinder 126 are designated by element 200 in FIGS. 8, 9 and 26.

Figure 26:
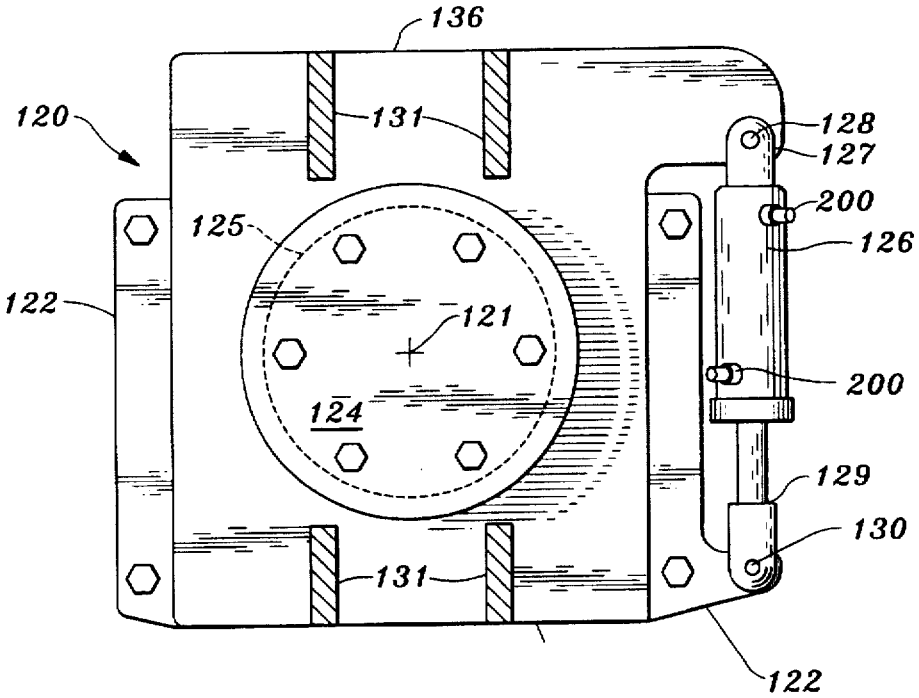
FIG. 26 is a view taken through line 26—26 of FIG. 25.
Figure 27:
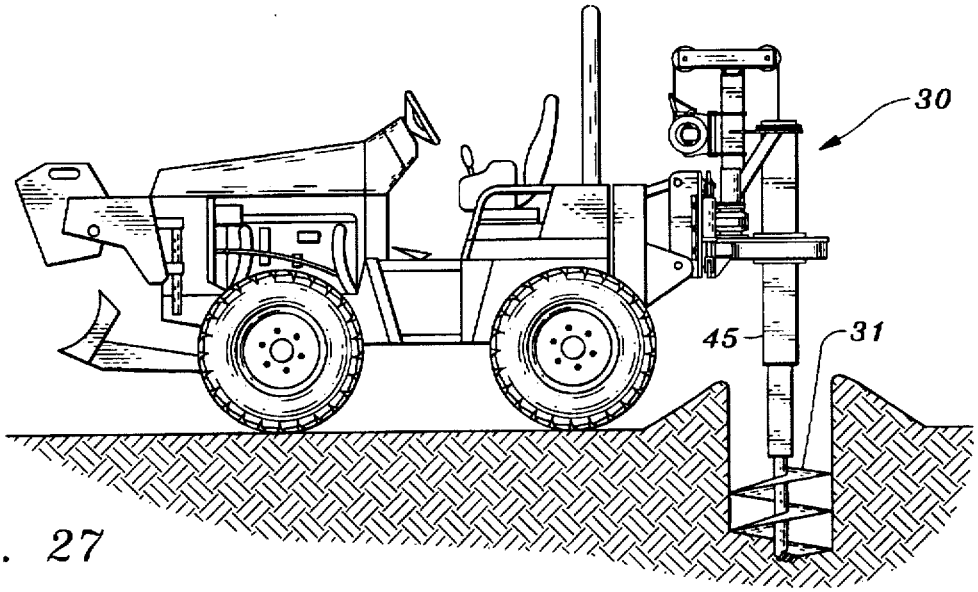
FIG. 27 shows a structure for mounting the augering means on a tractor.
Figure 28:
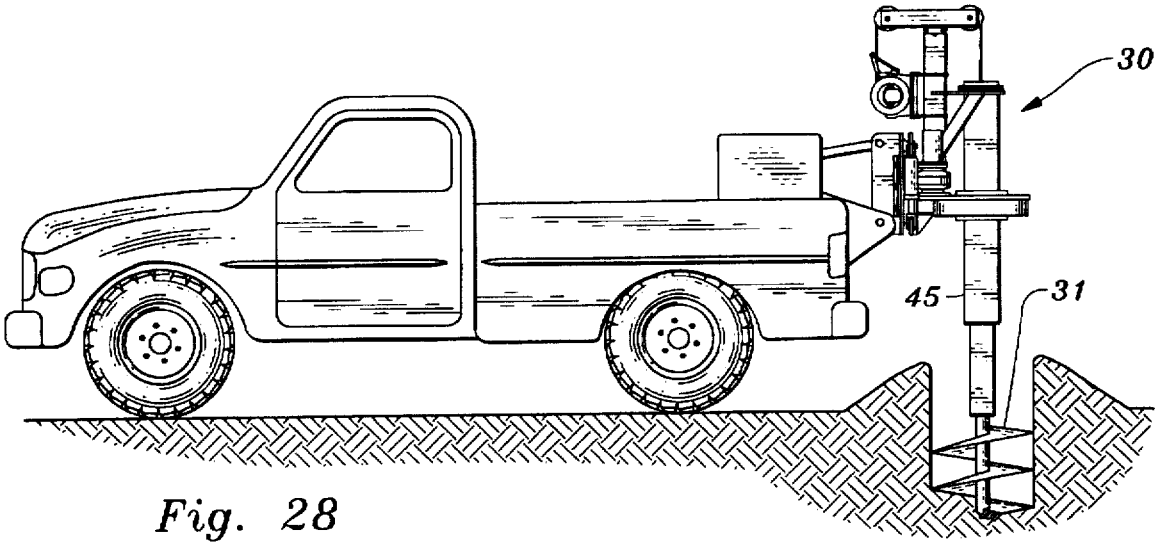
FIG. 28 shows a structure for mounting the augering means on a truck.

The augering means of this invention can also be mounted from a truck bed or tractor as shown in FIGS. 26 and 27.

Hydraulic hoses are not shown since such detail is not needed by one skilled in the art.

One advantage of this invention is the fact that the kelly sections can be easily changed to better suit a particular drilling requirement since the top of the kelly assembly is opened. For example, if the overhead is extremely low a kelly assembly with shorter kellys and a shorter mast assembly can be used. On the other hand if overhead is not a problem longer kellys, or longer and fewer kellys can be used with the installation of a longer extendable mast assembly 35. Such changes can be completed in a couple of hours. This allows the augering means to be quickly tailored to the drilling site thereby reducing the number and kinds of drilling rigs required by a drilling contractor.

To change or service the kellys, bolts 144 and members 61, 142 and 143 are removed, see FIG. 24. Swivel 57 is detached from inner kelly section 47, another cable is connected to section 47, and the interjacent kelly sections and inner kelly section 47 are lifted as an unit from shroud 72. Lower plate 140 fastened to inner kelly section 47 allows all interjacent kelly sections to be pulled from outer kelly section 45 with inner kelly section 47. If desired the entire kelly assembly including outer kelly section 45 and extendable mast assembly 35 can be removed and another kelly assembly and extendable mast assembly substituted in place thereof.

In FIGS. 8, 9 and 12 the interjacent kelly sections are shown concentrically however, it is to be understood that when using stops only on two adjacent walls of each kelly section as described earlier, the kelly sections will not be exactly concentric to each other. Furthermore, in the embodiment shown in FIGS. 8, 9 and 12 there are only two interjacent kelly sections. To draw more interjacent kelly sections in these figures would crowd the lines. It is to be understood, however, that any number of kelly sections can be used limited by the space available in shroud 72.

While the preferred embodiments of the present invention have been described, various changes and modifications may be made thereto without departing from the spirit of the invention and the scope of the appended claims. The present disclosure and embodiments of this invention described herein are for purposes of illustration and example and modifications and improvements may be made thereto without departing from the spirit of the invention or from the scope of the claims The claims, therefore, are to be accorded a range of equivalents commensurate in scope with the advances made over the art.

what is claimed is:

1. Augering means comprising:

extendable mast means having a first mast member and a second mast member, the first mast member having an axis;

downcrowding means for extending the second mast member away from the first mast member and for pulling the second mast member towards the first mast member;

kelly assembly means having a plurality of telescoping kelly sections which include at least an outer kelly section and an inner kelly section, the outer kelly section having an axis parallel to and spaced apart from the axis of the first mast member;

kelly bearing means for rotatably supporting the outer kelly section and for preventing axial displacement of the outer kelly section relative to the kelly bearing means;

first support means for supporting the kelly bearing means, and for causing displacement of the outer kelly section along the axis thereof in response to displacement of the second mast member along the axis of, and relative to, the first mast member;

kelly rotating means for slidably rotating the outer kelly section about the axis thereof; and second support means for supporting the first mast member and for supporting the kelly rotating means.

2. The augering means of claim 1, further comprising means for restricting the second mast member to slidable movement along the axis of the first mast member.

3. The augering means of claim 1, further comprising kelly retraction means for retracting the plurality of telescoping kelly sections and for permitting extension thereof.

4. The augering means of claim 3, wherein the kelly retraction means comprises winch means supported by the second mast member, pulley means fixed to the second mast member, swivel means connected to the inner kelly, and a cable connected to the swivel means and the winch means and carried by the pulley means.

5. The augering means of claim 4, wherein the winch means has a drum having an axis, and wherein the winch means includes means for coiling the cable on the drum at an approach angle approximately perpendicular to the drum axis regardless of where on the drum the cable is wound.

6. The augering means of claim 4, wherein the winch means is pivotally supported by the second mast member about an axis parallel to the axis of the first mast member.

7. The augering means of claim 4, wherein the winch means has a drum having an axis and an axial length, wherein the kelly retraction means includes roller means for coiling the cable in adjacent spirals on the drum, the roller means having a roller having an axis and an axial length at least as long as the axial length of the drum, and wherein the roller axis is parallel to the drum axis.

8. The augering means of claim 1, wherein the second mast member is tubular and slidable over the first mast member with a clearance therebetween, the clearance being operable for maintaining axial alignment of the second mast member with the axis of the first mast member.

9. The augering means of claim 1, the downcrowding means includes a hydraulic cylinder connected to the first mast member and the second mast member.

10. The augering means of claim 1, wherein the first support means is fixed to the second mast member.

11. The augering means of claim 1, wherein the extendable mast means is non-rotatable relative to the second support means.

12. The augering means of claim 1, wherein the first mast member is tubular and has an inner surface and an outer surface;

wherein the second mast member is tubular and has an inner surface and an outer surfaces and wherein the inner surface of the second mast member is slidable over the outer surface of the first mast member.

13. The augering means of claim 12, wherein the downcrowding means is located within the first mast member and within the second mast member.

14. The augering means of claim 12, wherein the first mast member and the second mast member have approximately a polygonal tubular configuration in cross section.

15. The augering means of claim 12, wherein the first mast member and the second mast member have approximately a square tubular configuration in cross section.

16. The augering means of claim 12, wherein the first mast member and the second mast member have approximately a circular tubular configuration in cross section.

17. The augering means of claim 16, wherein one of the first mast member and the second mast member includes a male key section oriented parallel to the axis of the first mast member and the other one of the first mast member and the second mast member includes a female key section slidable over the male key section.

18. The augering means of claim 1, wherein the response to the displacement of the outer kelly section along the axis thereof in response to displacement of the second mast member along the axis of, and relative to, the first mast member is proportional.

19. The augering means of claim 1, wherein the inner kelly section is driven directly by the outer kelly section.

20. The augering means of claim 1, wherein the inner kelly section is driven indirectly by the outer kelly section, and wherein the plurality of kelly sections is from 3 to 15.

21. The augering means of claim 1, wherein the kelly rotating means is driven by chain drive means.

22. The augering means of claim 1, wherein the kelly rotating means is driven by gear drive means.

23. The augering means of claim 1, wherein the kelly rotating means is hydraulically powered.

24. The augering means of claim 1, further comprising yoke means having an axis perpendicular to the axis of the first mast member, the yoke means for rotating the outer kelly section about the axis of the yoke means.

25. The augering means of claim 24, wherein the yoke means has a first member rotatably mounted on a second member about the yoke axis, and wherein the second support means is fixed to the first member.

26. The augering means of claim 1, wherein the kelly assembly means has at least one interjacent kelly section, wherein each kelly section has at least four faces, and wherein stops are present only on two adjacent faces of each interjacent kelly section at both distal ends thereof.

27. Augering means comprising:

extendable mast means having a first mast member and a second mast member, the first mast member having an axis;

downcrowding means for extending the second mast member away from the first mast member and for pulling the second mast member towards the first mast member;

kelly assembly means having a plurality of telescoping kelly sections which include at least an outer kelly section and an inner kelly section, the outer kelly section having an axis parallel to and spaced apart from the axis of the first mast member;

kelly bearing means for rotatably supporting the outer kelly section and for preventing axial displacement of the outer kelly section relative to the kelly bearing means;

first support means for supporting the kelly bearing means, and for causing displacement of the outer kelly section along the axis thereof equal to displacement of the second mast member along the axis of, and relative to, the first mast member;

kelly rotating means for slidably rotating the outer kelly section about the axis thereof; and second support means for supporting the first mast member and for supporting the kelly rotating means.

28. Augering means comprising:

extendable mast means having a first mast member and a second mast member, the first mast member having an axis;

means for restricting the second mast member to slidable movement along the axis of the first mast member;

downcrowding means for extending the second mast member away from the first mast member and for pulling the second mast member towards the first mast member;

kelly assembly means having a plurality of telescoping kelly sections which include at least an outer kelly section and an inner kelly section, the outer kelly section having an axis parallel to and spaced apart from the axis of the first mast member;

kelly bearing means for rotatably supporting the outer kelly section and for preventing axial displacement of the outer kelly section relative to the kelly bearing means;

first support means for supporting the kelly bearing means, and for causing displacement of the outer kelly section along the axis thereof in response to displacement of the second mast member along the axis of, and relative to, the first mast member;

kelly rotating means for slidably rotating the outer kelly section about the axis thereof;

second support means for supporting the first mast member and for supporting the kelly rotating means; and kelly retraction means for retracting the plurality of telescoping kelly sections and for permitting extension thereof.

29. Augering means comprising:

extendable mast means having a first mast member and a second mast member, the first mast member having an axis;

downcrowding means for extending the second mast member away from the first mast member and for pulling the second mast member towards the first mast member;

kelly assembly means having a plurality of telescoping kelly sections which include at least an outer kelly section and an inner kelly section, the outer kelly section having an axis parallel to and spaced apart from the axis of the, first mast member;

kelly bearing means for rotatably supporting the outer kelly section and for preventing axial displacement of the outer kelly section relative to the kelly bearing means;

first support means for supporting the kelly bearing means, and for causing displacement of the outer kelly section along the axis thereof in response to displacement of the second mast member long the axis of, and relative to, the first mast member;

kelly rotating means for slidably rotating the outer kelly section about the axis thereof;

second support means for supporting the first mast member and for supporting the kelly rotating means; and winch means for retracting kelly sections, the winch means comprising:

a drum rotatably supported by a frame member, the drum having an axis, the drum for coilable storage of a cable attached at one of its ends to the drum to the drum and at the other of its ends to one of the kelly sections;

motor means for rotating the drum; and mounting means having a pivot axis which lies in a plane perpendicular the drum axis, the mounting means for pivotally supporting the frame member about the pivot axis, the mounting means for attaching to a downcrowdable member, thereby enabling the cable to be wound onto the drum at an approach angle approximately perpendicular to the drum axis regardless of where on the drum the cable is wound.

* * * * *